United States Patent [19]

Cabrera et al.

[11] Patent Number: 4,849,091

[45] Date of Patent: Jul. 18, 1989

[54] PARTIAL CO COMBUSTION WITH STAGED REGENERATION OF CATALYST

[75] Inventors: Carlos A. Cabrera, Northbrook; Daniel N. Myers, Arlington Heights; Harold U. Hammershaimb, Western Springs, all of Ill.

[73] Assignee: UOP, Des Plaines, Ill.

[21] Appl. No.: 182,812

[22] Filed: Apr. 18, 1988

Related U.S. Application Data

[63] Continuation-in-part of Ser. No. 908,531, Sep. 17, 1986, abandoned.

[51] Int. Cl.[4] ..... C10G 13/18

[52] U.S. Cl. ..... 208/113; 208/DIG. 1; 208/159; 208/153; 422/140

[58] Field of Search ..... 208/113, 111, 153, 157, 208/148, 159, 163, 164, DIG. 1, 157; 422/140, 144

[56] References Cited

U.S. PATENT DOCUMENTS

| | | | |
|---|---|---|---|
| 3,494,858 | 2/1970 | Luckenback | 208/164 |
| 3,563,911 | 2/1971 | Pfeiffer et al. | 422/144 X |
| 3,753,893 | 8/1973 | Wooyanglee et al. | 208/164 |
| 3,893,812 | 7/1975 | Conner et al. | 208/164 |
| 3,919,115 | 11/1975 | Stine et al. | 208/164 |
| 3,953,175 | 4/1976 | Pulak | 208/164 |
| 4,197,189 | 4/1980 | Thompson et al. | 208/164 |
| 4,211,630 | 7/1980 | Gross et al. | 208/164 |
| 4,234,411 | 11/1980 | Thompson | 208/164 |
| 4,340,566 | 7/1982 | Thompson et al. | 422/144 X |
| 4,371,453 | 2/1983 | Vickers | 208/164 |
| 4,477,335 | 10/1984 | Benslay | 208/113 |

*Primary Examiner*—Glenn Caldarola

*Attorney, Agent, or Firm*—Thomas K. McBride; John F. Spears, Jr.

[57] ABSTRACT

FCC catalyst is regenerated in a process providing increased coke-burning capacity without additional heat evolution or air consumption. The process uses a two-stage regeneration arrangement providing initial coke combustion in a low catalyst density-high efficiency contact zone followed by substantial separation of catalyst and regeneration gas and complete regeneration of catalyst particles in a dense bed regeneration zone. Catalyst and gas flow cocurrent prior to this separation but flow countercurrent after the separation. An effective control scheme for regulating oxygen addition to the final zone is also disclosed. This process is applicable to FCC operations for conventional and residual feedstocks.

11 Claims, 2 Drawing Sheets

PARTIAL CO COMBUSTION WITH STAGED REGENERATION OF CATALYST

CROSS-REFERENCE TO RELATED APPLICATION

This application is a continuation-in-part of our prior copending application Serial No. 908,531 filed Sept. 17, 1986 abandoned.

BACKGROUND OF THE INVENTION

The invention relates to a method of regenerating used hydrocarbon conversion catalyst by the combustion of coke on the catalyst in a fluidized combustion zone. This invention specifically relates to a process for the conversion of heavy hydrocarbons into lighter hydrocarbons with a fluidized stream of catalyst particles and regeneration of the catalyst particles to remove coke which acts to deactivate the catalyst.

Fluidized catalytic cracking is a hydrocarbon conversion process accomplished by contacting hydrocarbons in a fluidized reaction zone with a catalyst composed of finely divided particulate material. The reaction in catalytic cracking, as opposed to hydrocracking, is carried out in the absence of added hydrogen or the consumption of hydrogen. As the cracking reaction proceeds substantial amounts of highly carbonaceous material referred to as coke is deposited on the catalyst. A high temperature regeneration within a regeneration zone operation burns coke from the catalyst. Coke-containing catalyst, referred to herein as spent catalyst, is continually removed from the reaction zone and replaced by essentially coke free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of fluidized catalytic cracking (FCC) processes. To this end the art is replete with vessel configurations for contacting catalyst particles with feed and regeneration gas respectively.

A common objective of these configurations is maximizing product yield from the reactor while minimizing operating and equipment costs. Optimization of feedstock conversion ordinarily requires essentially complete removal of coke from the catalyst. This essentially complete removal of coke from catalyst is often referred to as complete regeneration. Complete regeneration produces a catalyst having less than 0.1 and preferably less than 0.05 weight percent coke. In order to obtain complete regeneration, oxygen in excess of the stoichiometeric amount necessary for the combustion of coke to carbon oxides is charged to the regenerator. Excess oxygen in the regeneration zone will also react with carbon monoxide produced by the combustion of coke thereby yielding a further evolution of heat.

When CO combustion occurs in a relatively catalyst free zone of the regenerator, such as the region above a dense fluidized bed, the resulting high temperatures may lead to severe equipment damage. Such situations may be avoided if the CO combustion takes place in the presence of catalyst particles which act as a heat sink. Therefore, regenerators are generally designed to avoid the combination of free oxygen and carbon monoxide in regions that are relatively free of catalyst. Despite this the heat evolved from unintended CO combustion may raise the temperature of the catalyst to the point of causing thermal deactivation of the catalyst or may affect the process by limiting the amount of catalyst that can contact the feedstock. The problems of controlling catalyst and regenerator temperatures are exacerbated by the application of FCC processes to crack heavy feedstocks. With the increased coke producing tendencies of these heavy or residual feeds a complete regeneration of catalyst becomes more difficult due to the excessive heat evolution associated with coke and CO combustion.

Aside from excessive heat evolution the complete oxidation of CO also increases overall oxygen demands for the regeneration process. In many cases the high oxygen requirements for complete regeneration may exceed the limited capacity of the regenerator air blower or other equipment in the regenerator and flue gas section. Therefore, it is also desirable to reduce CO combustion so that a greater quantity of the available air supply is used to oxidize coke from the catalyst.

INFORMATION DISCLOSURE

One way to minimize CO combustion and yet obtain fully regenerated catalyst is by performing the regeneration in stages. Staged regeneration systems are well known in the regeneration of FCC catalyst. Luckenbach, U.S. Pat. No. 3,958,953, describes a staged flow system having concentric catalyst beds separated by baffles which open into a common space for collecting spent regeneration gas and separating catalyst particles. Myers et al. in U.S. Pat. No. 4,299,687 teach the use of a staged regenerator system having superimposed catalyst beds wherein spent catalyst particles first enter an upper dense fluidized bed of catalyst and are contacted with regeneration gas from the lower catalyst bed and fresh regeneration gas. After partial regeneration in the first regeneration zone, catalyst particles are transferred by gravity flow into a lower catalyst bed to which is charged a stream of fresh regeneration gas. The Myers invention is directed to the processing of residual feeds and uses the two stage regeneration process to limit CO combustion thereby reducing overall heat output within the regenerator.

The use of relatively dilute phase regeneration zones to effect complete catalyst regeneration is shown by Stine et al. in U.S. Pat. Nos. 3,844,973 and 3,923,686. Stine et al. seeks primarily to effect complete CO combustion for air pollution, thermal efficiency, and equipment minimization reasons by using increased gas velocities to transport catalyst through dense bed and relatively dilute phase regeneration zones. A two stage system which combines a relatively dilute phase transport zone with a dense bed zone for regenerating catalyst used in cracking residual feeds is shown by Dean et al. in U.S. Pat. No. 4,336,160. In Dean a first dense bed is used to initiate coke combustion in a lower portion of a regeneration section which is followed by an upper dilute phase regeneration section operating at high severity to complete regeneration and combustion of carbon monoxide.

In the various methods of practicing staged regeneration it is necessary to supply fresh regeneration gas to each regeneration zone. Control of the regeneration gas to each zone allows the degree of coke combustion and CO oxidation to be determined for each stage. Therefore, it is desirable to minimize the interdependence of gas flow rates upon different stages of regeneration. Multistage regeneration systems in which spent or partially spent regeneration gas from one regeneration stage enters another stage have flow rate and oxygen concentration constraints that interfere with the control of CO combustion. Although allowing the optimum in control, essential isolation of the regeneration gas streams results in higher equipment costs due to the need for extra separation devices and piping.

Partial isolation of a regeneration gas stream entering a final regeneration zone is taught by Benslay in U.S. Pat. No. 4,477,335. This reference also shows the use of a single catalyst separation section for all regeneration stages located in the final regeneration zone. However, this method and apparatus uses multiple dense beds with an unusual downflow riser to transfer catalyst to a final stage located at the lowermost portion of the regenerator.

U.S. Pat. No. 3,563,911 issued to R. W. Pfeiffer et al. illustrates a multistage FCC catalyst regeneration zone. The spent catalyst is fed into a dense bed of fluidized catalyst. Each stage appears to be operated at similar conditions. Catalyst of various degrees of regeneration collected in the common vapor volume above the horizontally contiguous regeneration stages is returned to the first regeneration stage. The oxygen supply to the regeneration zone is controlled to provide a small amount of afterburning.

U.S. Pat. No. 3,953,175 issued to R. P. Pulak is believed pertinent for its showing that catalyst can be regenerated in a vertical chamber having a smaller diameter section which acts as a riser to transfer regenerated catalyst. This process appears to be directed to the complete combustion of CO to $CO_2$.

U.S. Pat. No. 4,197,189 issued to G. J. Thompson et al. illustrates a process for the regeneration of spent FCC catalyst wherein the catalyst flows upward through a cylindrical combustion zone and is then discharged in a manner providing for gas-catalyst separation. All of the regeneration oxygen appears to enter this combustion zone, which therefore is believed to be properly described as a single stage of combustion despite dual air feed points. Regenerated hot catalyst is collected and partially recycled to the bottom of the combustion zone.

In contrast to the prior art the present invention uses fast fluidized flow conditions, hereinafter described, in a first stage of regeneration to provide a highly efficient contacting of catalyst and oxygen which will minimize the presence of free oxygen in the spent regeneration gas from the first regeneration stage thereby facilitating control of CO combustion in subsequent stages of the regeneration process. The catalyst and combustion gas flow upward concurrently prior to a gas-solids separation. Subsequent catalyst flow is countercurrent to rising gas emanating from a dense bed of catalyst.

OBJECTS AND EMBODIMENTS

It is an object of this invention to provide a process for regenerating catalyst with minimum oxygen input requirements and minimum heat output. It is a further object of applicants' invention to maximize the flexibility of regeneration operations within a two-stage regeneration system with minimum equipment demands. These objectives are met using a dual combustion stage process featuring intermediate separation of the catalyst and regeneration gases. The oxygen availability and other operational characteristics differ between the stages.

Accordingly, a broad embodiment of the present invention is a process for the regeneration of spent hydrocarbon conversion catalyst containing coke which has been removed from a fluidized catalytic reaction zone, which process comprises the steps of passing to a lower locus of a combustor zone of a regeneration zone spent catalyst from said reaction zone, a stream consisting of regenerated catalyst from a hereinafter described dense bed regeneration zone, and a first oxygen containing regeneration gas stream in an amount sufficient to maintain fast fluidized conditions within said combustor zone and to oxidize coke along with coke combustion by-products; oxidizing coke and coke combustion by-products in said combustor zone while transporting said spent and regenerated catalyst upward in cocurrent flow with rising regeneration gas; passing at least a portion of said spent and regenerated catalyst and regeneration gas upward in cocurrent flow from the combustor zone into a riser regeneration zone located above said combustion zone and having a lower catalyst density than said combustor zone, and therein oxidizing coke and coke combustion by-products to produce partially regenerated catalyst and a spent first regeneration gas having a mole ratio of $CO_2/CO$ of from about 0.7 to about 2.0; discharging partially regenerated and regenerated catalyst, and said spent first regeneration gas from an upper locus of said riser regeneration zone into a catalyst disengagement zone through an outlet means that effects at least a partial separation of catalyst and regeneration gas and thereby causing an initial separation of catalyst from said spent first regeneration gas; allowing at least 70 wt. % of the partially regenerated and regenerated catalyst discharged through said outlet means to settle into a dense fluidized bed of a dense bed regeneration zone located below said disengagement zone while flowing countercurrent to a rising second regeneration gas which contains at least 0.5 mole percent oxygen, and introducing into the dense fluidized bed a second oxygen containing regeneration gas stream in a quantity at least sufficient to produce regenerated catalyst having less than 0.1 wt. % coke and to oxidize essentially all of the carbon monoxide produced within said dense bed regeneration zone to carbon dioxide; combining said spent first regeneration gas with the second regeneration gas, which emanates from said dense bed regeneration zone in said disengagement zone, and producing a combined spent regeneration gas having a $CO_2/CO$ mole ratio in the range of about 1 to 5; withdrawing said combined spent regeneration gas from the disengagement zone; and withdrawing regenerated catalyst from said dense bed having an average temperature in the range of 620 to 787 degrees Celsius and returning at least a first portion of said regenerated catalyst to said reaction zone and at least a second portion of regenerated catalyst to the lower locus of the combustor zone as set out above.

In an alternative embodiment the invention is a process for the regeneration of particulate hydrocarbon cracking catalyst withdrawn from a fluidized catalytic cracking reaction comprising the steps of passing a stream comprising spent catalyst from said reaction zone to a lower locus of a combustion zone together with regenerated catalyst from a hereinafter described dense bed regeneration zone and an oxygen containing regeneration gas stream in sufficient quantity to obtain fast fluidized conditions within said combustion zone and to oxidize coke and coke combustion by-products including carbon monoxide; oxidizing coke and coke combustion by-products in said combustion zone while transporting catalyst upward cocurrent with regeneration gas; passing catalyst and regeneration gas mixture to a riser regeneration zone located above said combustion zone and operated at lower catalyst density than said combustion zone and therein oxidizing coke and coke combustion by-products to produce partially regenerated catalyst and a spent (oxygen-depleted) first regeneration gas having a mole ratio of $CO_2/CO$ of from about 0.7 to 2.0; discharging said partially regenerated catalyst, recirculated regenerated catalyst and spent first regeneration gas from an upper locus of said riser regeneration zone into a catalyst disengagement zone through an outlet means that effects at least a partial separation of catalyst and regeneration gas and thereby causing an initial separation of partially regenerated catalyst from said first regeneration gas; collecting at least a major portion of said partially regenerated and recirculated catalyst discharged into the catalyst disengagement zone through said outlet in a dense bed regeneration zone located below said disengagement zone, introducing into the dense bed regeneration zone a second oxygen containing regeneration gas stream at a rate which is adjusted in response to a hereinafter defined output signal; combining said spent first regeneration gas with a second regeneration gas which rises upward from said dense bed regeneration zone in said disengagement zone countercurrent to descending catalyst to obtain a combined regeneration gas having a $CO_2/CO$ mole ratio of from 1 to about 5 and which is greater than the mole ratio of $CO_2/CO$ of said spent first regeneration gas, separating entrained catalyst from the combined spent regeneration gas, removing the combined regeneration gas from said disengagement zone and returning the entrained catalyst to said dense bed regeneration zone; measuring the temperature of the combined regeneration gas, comparing said temperature to a predetermined or variable set point, and generating from this comparison an output signal which determines the flow rate of oxygen containing regeneration gas stream to the dense bed regeneration zone such that said set point is not exceeded; and withdrawing regenerated catalyst from said dense bed regeneration zone having an average temperature in the range of 620–787 degrees Celsius (1150 to 1450 degrees Fahrenheit) and returning said regenerated catalyst particles to said reaction zone.

DETAILED DESCRIPTION OF THE INVENTION

This invention is directed to an arrangement for removing carbon deposits referred to as coke from the surface and pores of catalyst used in a hydrocarbon conversion process. A preferred embodiment of the invention is a two-stage FCC regeneration process. The first regeneration stage utilizes fast fluidization conditions in a high efficiency regeneration stage for partially regenerating spent hydrocarbon cracking catalyst while yielding a CO rich spent regeneration gas. A second regeneration stage uses a dense bed to complete regeneration of the catalyst.

The completely regenerated catalyst of this process is obtained with a significantly reduced heat output and with a lower oxygen requirement per pound of coke burned than required to obtain similar catalyst from regenerators not incorporating the features of the present invention. Reducing the heat output allows the burning of additional coke within the regenerator without a subsequent increase in regenerator temperatures. Furthermore lower oxygen requirements per pound of coke burned permits burning additional coke for a given oxygen supply.

Alternately the invention may be employed to lower the temperature of the regenerated catalyst thereby allowing operational changes in the reaction zone. It has been recognized that high regeneration temperatures of past regeneration schemes did not provide catalyst at optimum condition for maximizing the yield of desired products from the reaction zone. As hereinafter demonstrated increased circulation of fully regenerated catalyst as a result of lower regenerated catalyst temperature offers definite advantages in maximizing product yield. Accordingly, the ability to obtain fully regenerated catalyst in an optimum temperature range is an important benefit of this process. By means of the present invention the temperature of the regenerated catalyst is easily controlled while obtaining complete regeneration of the catalyst in a highly efficient manner.

Figure 1:
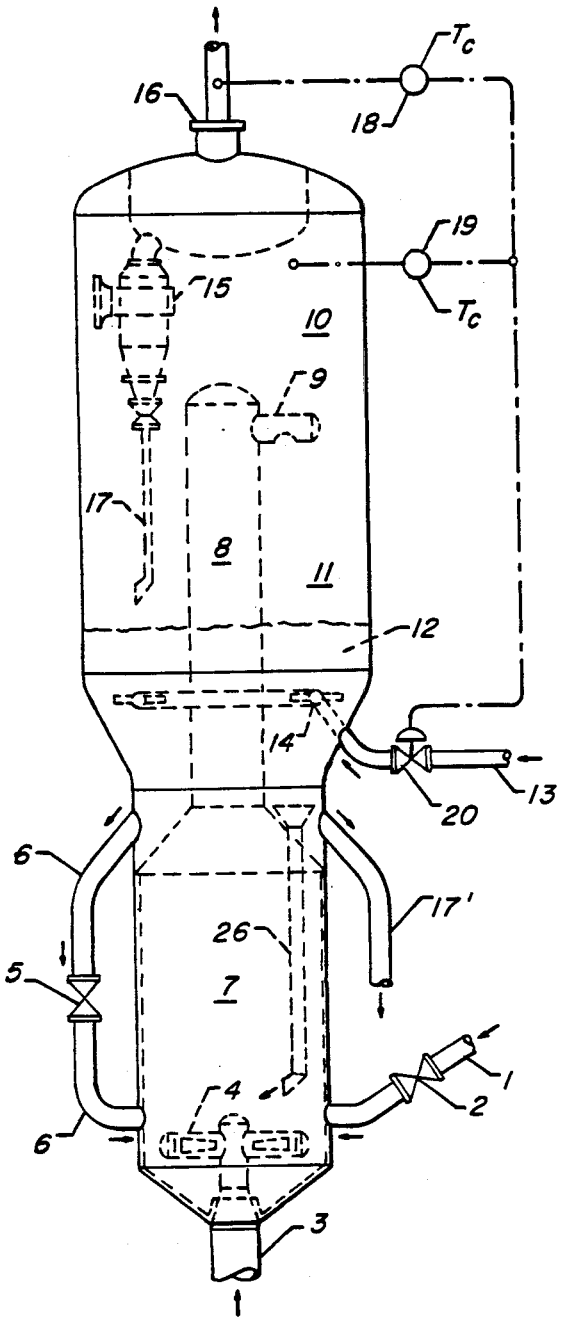
FIG. 1 is a cross sectional view of a suitable regenerator for performing the subject process.

Referring now to the accompanying drawings the regeneration process of the present invention will be described in more detail. In FIG. 1 spent coke-containing catalyst from a reaction zone enters the lower portion of combustion zone 7 through conduit 1 containing control valve 2. The catalyst from the reactor usually contains carbon in an amount of from 0.2 to 2 wt. %, which is present in the form of coke. Although coke is primarily composed of carbon it may contain from 3 to 15 wt. % hydrogen as well as sulfur and other materials. An oxygen containing regeneration gas, typically air, enters a lower portion of the combustion zone through conduit 3 and is distributed across combustor zone 7 by distributor 4. As the regeneration gas enters the combustion zone it contacts spent catalyst.

In order to accelerate combustion of the coke, hot regenerated catalyst from dense bed regeneration zone 12 may be recirculated into the combustor zone via conduit 6 which contains control valve 5. Recirculation of regenerated catalyst, by mixing hot catalyst from dense bed regeneration zone 12 with relatively cold spent catalyst entering the combustor zone, raises the overall temperature of the catalyst and gas mixture in combustion zone 7. Aside from external standpipe 6, several other methods of effecting catalyst recirculation are well known. For instance, catalyst may be transferred internally by internal standpipe 26.

The catalyst and gas mixture then enter riser regeneration zone 8, which is operated at a higher gas velocity due to its reduced cross section. The primary function of the first regeneration stage comprising combustion zone 7 and riser regeneration zone 8 is to maximize coke combustion to carbon monoxide while limiting the combustion of CO to $CO_2$ thereby minimizing oxygen consumption per unit of coke burned. Typically the amount of coke removed in this first regeneration stage comprises from about 50% to 90% of the coke on entering spent catalyst. The minimization of CO combustion to $CO_2$ results in an increase in capacity for burning additional coke deposits and at the same time minimizes heat evolution and air requirements during regeneration. The additional coke burning capacity increases the flexibility of the reaction zone in processing feeds having increased coke producing tendencies.

The mixture of catalyst particles and regeneration gas, which is spent due to oxygen consumption, is discharged from an upper portion of riser zone 8. Both totally regenerated recirculated catalyst and partially regenerated catalyst exit the top of riser zone 8. Discharge is effected through disengaging device 9 which separates a majority of the partially regenerated catalyst from the spent regeneration gas. Initial separation of catalyst upon exiting riser zone s minimizes the catalyst loading on cyclone separators or other downstream devices used for the essentially complete removal of catalyst particles from the spent regeneration gas thereby reducing overall equipment costs. This initial separation also makes possible the operation of the upper section of the vessel at higher gas velocities than would be possible in the case of a conventional fluidized bed. There are various flow devices known to those skilled in the art, that will perform the preliminary catalyst and gas separation any of which would be suitable for use in this invention as disengaging device 9. Following the initial catalyst and gas separation, regeneration gas and a minor portion of the catalyst still entrained therein will rise into the upper portion of a disengaging space 10. A major portion, at least 70 and preferably 80 wt. %, of the catalyst now disengaged from the regeneration gas falls through the disengaging space 11 countercurrent to regeneration gases.

Downward moving disengaged catalyst collects in dense bed regeneration zone 12. Catalyst densities in this zone are typically kept within a range of from about 480–800 Kg per cubic meter (30 to 50 pounds per cubic foot). A second quantity of oxygen-containing regeneration gas typically air, enters this dense bed regeneration zone through conduit 13 and distribution device 14. Approximately 10 to 50 percent of the total oxygen requirements within the process for the essentially complete regeneration of the catalyst enters dense bed regeneration zone z. Although the total quantity of regeneration gas charged to dense bed regeneration zone 12 represents half or less of the total regeneration gas to the process it will be adequate to provide this amount of regeneration gas since catalyst entering the dense bed regeneration zone contains less than half of its original coke deposits. The oxygen requirements for complete regeneration in the dense zone are commensurately reduced. Therefore, catalyst in the dense bed regeneration zone is completely regenerable to a carbon content of less than 0.1 wt. %.

The flow of catalyst and gas is cocurrent in the riser regeneration zone. After discharge from the riser, the catalyst flows countercurrent to rising gases. The highest oxygen concentration is therefore present at different ends of the two combustion zones. In the riser regeneration zone, oxygen concentration is highest at the point of greatest carbon content on the catalyst. In the countercurrent disengaging area and in the dense bed regeneration zone, the highest oxygen level exists in unison with the most highly regenerated catalyst.

Regeneration gas containing at least 0.5 mole percent oxygen rises from the bed and passes upward through disengagement space 11. The downward discharge of disengaged catalyst from separation device 9 increases the concentration of catalyst in the dilute phase above the dense bed thereby providing an additional region in which coke and CO oxidation may take place as the falling catalyst particles contact the oxygen containing regeneration gas. As the regeneration gas from the dense bed regeneration zone 12 continues to rise it is combined with regeneration gas from the first combustion zone in upper disengaging space 10 These two streams upon first contact have a combined $CO_2/CO$ mol ratio of between 1 to 5 and of course greater than the same ratio in the regeneration gas exiting the riser. Oxygen present in the regeneration gas from the dense bed regeneration zone may cause oxidation of carbon monoxide in the upper disengaging space. Although the overall heat output and final regeneration gas temperature will increase, this burning of coke and CO in the dilute phase above the dense bed and in the disengaging zone will not cause a major increase in catalyst temperatures due to the amount of catalyst present. Therefore, the invention contemplates a variation in temperatures for the regeneration gas in the various zones. For example, when carbon monoxide is combusted in the upper portion of the disengagement zone the differential between the temperature of the riser regenerator gas entering the disengagement zone and the combined regeneration gas can reach from 27.8–111 Celsius degrees (50–200 Fahrenheit degrees).

The combined regeneration gas stream and entrained particles of catalyst enter one or more separation means, such as cyclone separator 15, which separates catalyst fines from the gas stream. Regeneration gas, relatively free of catalyst is withdrawn from the regenerator through outlet 16 while recovered catalyst is returned to the dense bed zone through dip leg 17 or other comparable means. From about 10 to 30 wt. % of the catalyst discharged from the riser regeneration zone is present in the gases above the exit from the riser regeneration zone and enter the cyclone separator. Catalyst from the dense bed regeneration zone is transferred through line 17' back to the reactor where it again contacts feed as the process continues.

For the purposes of this invention the term high efficiency regeneration refers to the use of fast fluidized flow conditions within an FCC regeneration section. Fast fluidization defines a condition of fluidized solid particles lying between the turbulent bed of particles and complete particle transport mode. A fast fluidized condition is characterized by a fluidizing gas velocity higher than that of a dense phase turbulent bed, resulting in a lower catalyst density and vigorous solid/gas contacting. In a fast fluidized zone, there is a net transport of catalyst caused by the upward flow of fluidizing gas. The catalyst density in the fast fluidized condition is much more sensitive to particle loading than in the complete particle transport mode. Therefore, it is possible to adjust catalyst residence time to achieve the desired combustion at the highly effective gas-solid, mixing conditions. From the fast fluidized mode, further increases in fluidized gas velocity will raise the rate of upward particle transport, and will sharply reduce the average catalyst density until, at sufficient gas velocity, the particles are moving principally in the complete catalyst transport mode. Thus, there is a continuum in the progression from a fluidized particle bed through fast fluidization and to the pure transport mode.

In this invention the combustion zone 7 will have a catalyst density of from 48 to 400 kg per cubic meter (3 to 25 pounds per cubic foot) and superficial gas velocities from about 0.91 to 3.05 meters per second (3 to 10 feet per second). Riser regeneration zone 8 is operated at a higher gas velocity which will usually exceed 3.05 meters per second (10 feet per second) and, therefore, will have a flow regime at the upper limit of fast fluidization conditions or the lower limit of the essentially pure transport mode. As a result the riser regeneration zone will have lower catalyst densities of from 16 to 128 kg per cubic meter (1 to 8 pounds per cubic foot), higher transport rates and reduced backmixing as compared to the combustor zone. Nevertheless the riser and combustion zones provide regions of lower catalyst density and vigorous mixing which are believed to be the most efficient for coke combustion and characterize a high efficiency regeneration. Therefore, the use of a first high efficiency contact assures removal of a major portion of coke from the catalyst in the initial regeneration stages. The addition of regeneration gas at conditions to promote high efficiency regeneration is sufficient to remove more than 50 percent and preferably between 65 and 90 wt. percent of the coke from the entering spent catalyst in the combustor and riser zones.

When oxidizing the carbon components of coke from the catalyst there are three principal reactions that can take place:

$C + O_2 \rightarrow CO_2$ (94.1 Kcal/mol C heat release)

$C + 1/2O_2 \rightarrow CO$ (26.4 Kcal/mol C heat release)

$CO + 1/2O_2 \rightarrow CO_2$ (67.7 Kcal/mol C heat release)

Thus in oxidizing the carbon either carbon monoxide or carbon dioxide is formed. The reaction equations show that maximizing the production of carbon monoxide while reducing the production of carbon dioxide minimizes the release of heat during regeneration. This minimization of heat release is substantial since less than one third as much heat is released in forming carbon monoxide than is released in forming carbon dioxide. Of course, it is ordinarily necessary to provide more than the stoichiometric requirement of oxygen for conversion of the carbon products in order to completely regenerate the catalyst. Thus complete regeneration requires sufficient excess oxygen which also reacts with carbon monoxide to yield carbon dioxide and additional heat. By restricting the oxygen concentration in a regeneration zone it is possible to suppress carbon monoxide conversion, but unfortunately coke removal is reduced at the same time.

In the subject invention the use of fast fluidization conditions provides optimum conditions for carbon removal and the complete utilization of oxygen. Therefore, it is possible to obtain a high percentage reduction of coke on the catalyst while still keeping the ratio of $CO_2$:CO in first combustion zone in the range of 0.7 to 2.0. Maintaining a low ratio of $CO_2$:CO while oxidizing a major portion of the coke lowers the overall temperature of the regeneration process and yields an oxygen deficient spent regeneration gas.

An additional benefit of reducing carbon monoxide combustion to carbon dioxide is a corresponding reduction in the total oxygen requirements for catalyst regeneration. Although the hereinafter described dense bed regeneration zone will also present a significant demand for oxygen, the overall oxygen requirements of the invention are significantly reduced. This reduction in oxygen requirements can be used to increase the coke burning capacity of a regenerator zone. Providing additional coke burning capacity without extra air is particularly useful where the coke burning capacity of the regenerator is limited by the size of the air blower.

Moreover the process of this invention is arranged in a manner that facilitates control of coke combustion and regulation of regeneration gas. First, each stream of regeneration gas only contacts the catalyst in one regeneration zone. Hence, regeneration gas from one zone does not interfere with the operations taking place in another zone. In stacked regeneration zones of the past the passage of regeneration gas from one zone to another zone interferes with control of coke combustion or regeneration temperature. For example, where a regeneration gas containing oxygen from a final combustion stage is circulated through a first combustion stage it is not possible to control the afterburning of CO to $CO_2$ by the quantity of free oxygen supplied to the final combustion stage.

By performing the first regeneration step in a high efficiency contact zone a greater utilization of available oxygen can be obtained in the first stage, enhancing the ability to control regeneration in the dense bed regeneration zone. As an aside, the mixing of partially spent regeneration gas with fresh regeneration gas in the subsequent dense bed regeneration zone, as practiced in the art, increases the superficial velocity through subsequent dense bed regeneration zones. Increased superficial velocity results in increased catalyst entrainment. This in turn requires separation devices of increased capacity. Of course, it is possible to provide individual separation means for each regeneration zone, thereby avoiding the disadvantage of passing spent regeneration gas through subsequent zones. However, such a step requires additional separation equipment. This invention combines the advantages of a single catalyst separation and flue gas section with lower catalyst entrainment while operating at higher overall gas rates.

Thus an FCC reaction zone associated with this invention can be used to process a conventional FCC feedstock or higher boiling hydrocarbon feeds. The most common of such conventional feedstocks is a "vacuum gas oil" (VGO), which is typically a hydrocarbon material having a boiling range of from 343 to 552 degrees Celsius (650 to 1025 degrees Fahrenheit) prepared by vacuum fractionation of atmospheric residue. Such a fraction is generally low in coke precursors and heavy metal contamination which can serve to contaminate catalyst.

Heavy hydrocarbon feedstocks to which this invention may be applied include heavy bottoms from crude oil, heavy bitumen crude oil, shale oil, tar sand extract, deasphalted residue, products from coal liquefaction, atmospheric and vacuum reduced crudes. Heavy feedstocks for this invention also include mixtures of the above hydrocarbons. However, the foregoing list is not intended to exclude the application of this process to other suitable feeds.

The heavy hydrocarbon fractions are also characterized by the presence of significant metal contamination. These metals accumulate on the catalyst and poison the catalyst by blocking reaction sites and promote overcracking thereby interfering with the reaction process. Therefore, the use of passivation or other metals management procedures within or before the reaction zone are anticipated when processing heavy feedstocks by this invention.

Therefore, one advantage of the process is that it allows the processing of heavier feedstocks in an existing unit with only a minor revamp or reduces the cost of a new unit designed to process heavier feeds. This benefit is a direct result of the increased coke burning capacity of the unit which can be attributed to the lower heat outputs and oxygen requirements for combustion per unit of coke. With regard to oxygen or air requirements, a typical high efficiency regenerator may require 14 kilograms of air per each kilogram of coke removed. By contrast, in the present invention complete regeneration may be obtained using as little as 11 kilograms of air per kilogram of coke.

It is also readily apparent that the present invention alternatively enables the processing of greater amounts of feed in a conventional reaction zone that employs the regeneration process of this invention than a process not employing the invention. However, the method of this invention can also improve the reactor performance when the quality or quantity of feed remains the same. This is a result of lower heat of combustion which leads to a lower catalyst temperature and greater catalyst circulation and with a commensurate increase in conversion.

Figure 2:
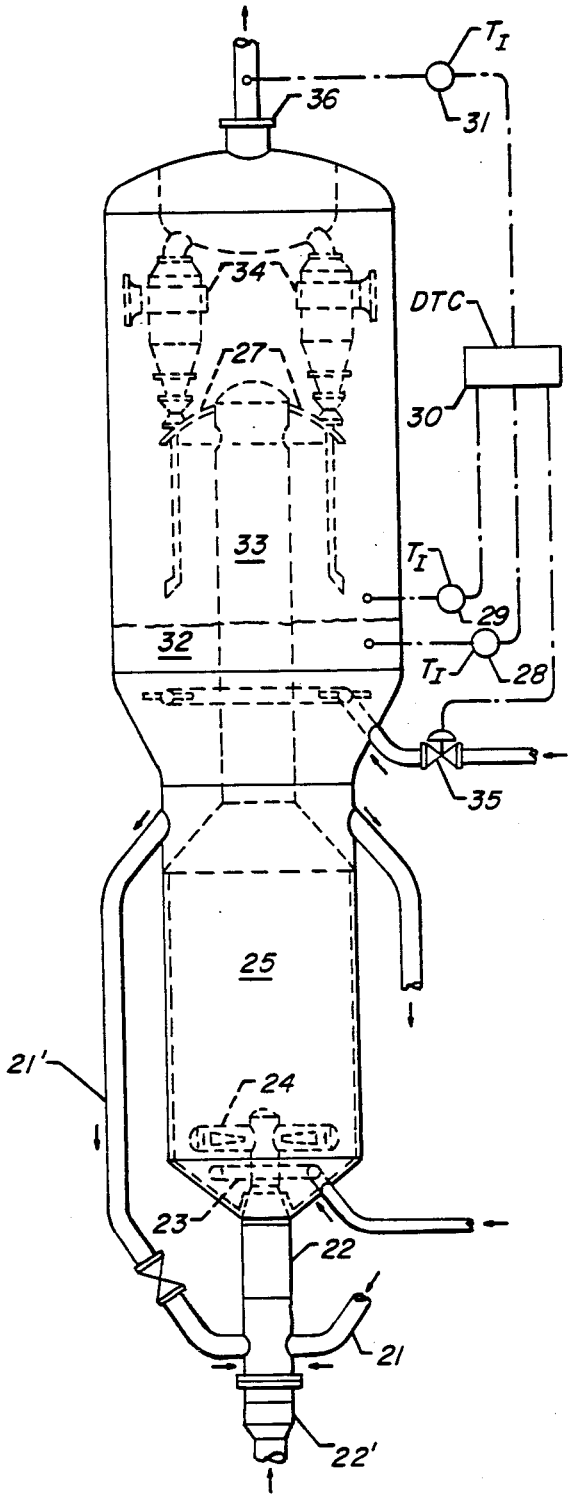
FIGS. 2 and 3 illustrate alternative regenerator configurations suitable for employing the invention.

Other embodiments of this invention are illustrated in FIG. 2 which depicts a somewhat modified regenerator configuration. The lower section of FIG. 2 illustrates a separate mixing zone for combining spent catalyst, regenerated catalyst and regeneration gas. In this configuration hot regenerated catalyst transported down extended standpipe 21' meets spent catalyst entering mixing riser 22 through conduit 21. Spent and regenerated catalyst are contacted with at least a portion of a first stream of oxygen containing regeneration gas from conduit 22' at a lower portion of mixing riser 22. The mixing riser has a reduced cross-sectional area in relation to the lower portion of the combustion zone to promote intimate mixing of the catalyst particles and gas stream. After mixing, the catalyst and gas mixture enter the lower portion of the first combustion zone 25 through distribution device 24 where it may be contacted with additional regeneration gas through inlet device 23. The operation of a mixing riser is more fully described by Thompson et al. in U.S. Pat. No. 4,340,566. FIG. 2 also depicts pipe arm separation device 27 as one possible alternative to separation device 9 of FIG. 1.

Figure 3:
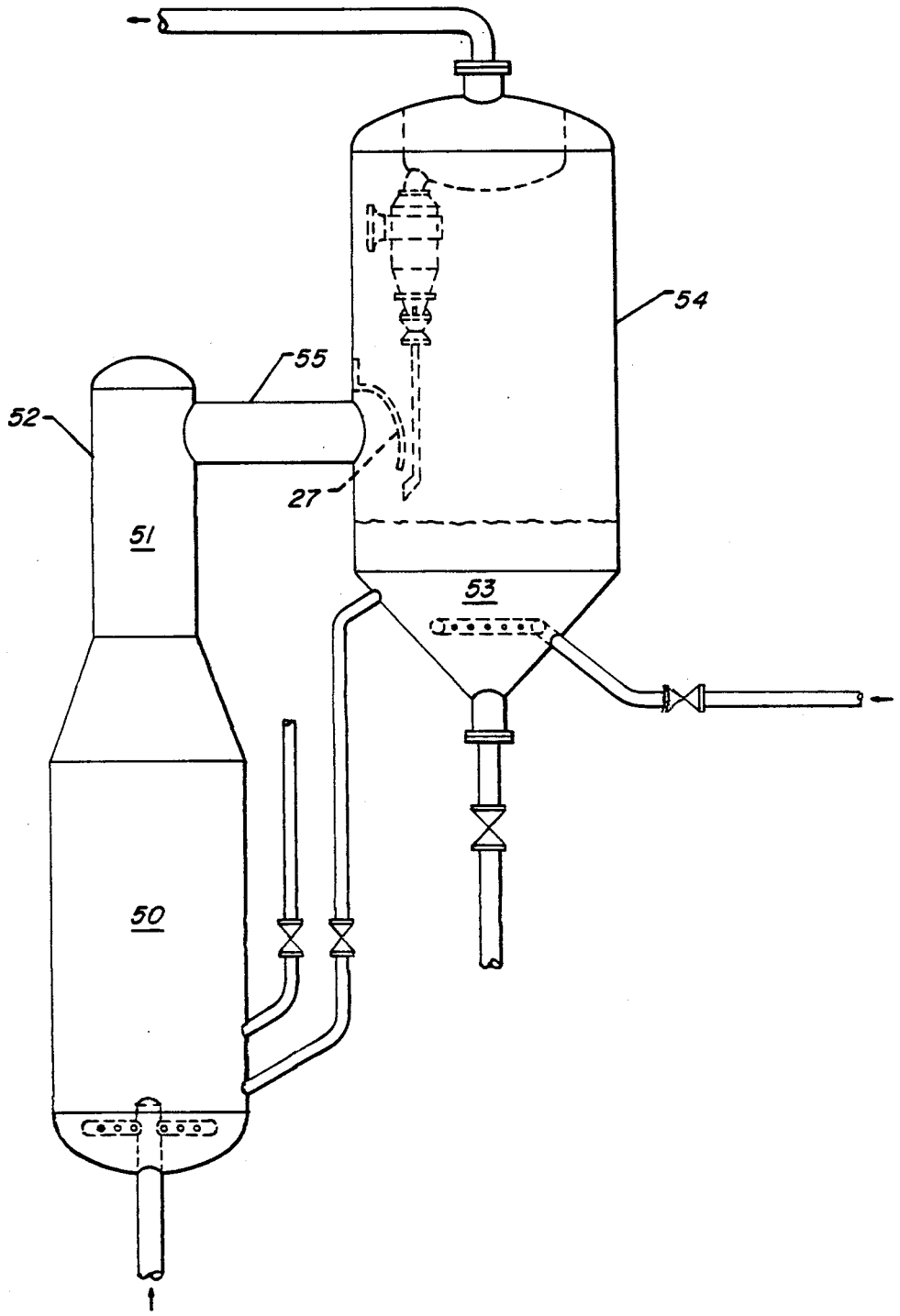

FIGS. 1 and 2 show a symmetrical configuration of the regeneration zones with the dense bed regeneration zone located above the combustor regeneration zone. However as demonstrated in FIG. 3, the riser 51 and combustor 50 zones may be contained in a separate vessel 52 and located adjacent to vessel 54 containing dense bed regeneration zone 53. Catalyst in this embodiment is transferred from the first regeneration stage to the dense bed regeneration zone by means of a horizontal transport riser 55. Thus the utilization of this invention is not limited to a symmetrical regenerator configuration but may be added to dense bed regeneration zones via the addition of a combustor, riser and transport conduit as taught by U.S. Pat. No. 3,953,175.

This invention also lends itself to a simple control method for regulating the addition of fresh regeneration gas to the dense bed regeneration zone. When operating a single stage dense bed regeneration zone it has been the practice to limit excess oxygen in the region above the dense bed to prevent so-called afterburning of carbon monoxide outside the bed of catalyst particles. Control of afterburning is also an objective of this invention due to the increased presence of carbon monoxide in the disengaging zone. It is possible to control the addition of regeneration gas to the dense bed zone by monitoring the spent regeneration gas temperature. In the control scheme of FIG. 1 the addition of regeneration gas to the dense bed regeneration zone is regulated by control valve 20 in response to a signal derived from either temperature controller 19, which senses the temperature in the upper portion of the disengagement zone, or from temperature controller 18 which senses the exiting regenerator gas temperature. The temperature controller may be set to keep the upper regenerator temperatures below the maximum equipment temperature.

Afterburning may also be employed beneficially as a means to monitor required oxygen addition rates or control regeneration gas addition to the dense bed zone. By measuring the temperature of the dense bed regeneration zone, the regeneration gas leaving the dense bed zone, the spent regeneration gas leaving the riser regeneration zone, or the two regeneration gas streams at the point of initial mixing, and comparing it to the temperature of the combined regeneration gas at a downstream location such as the upper portion of the disengagement space or spent regeneration gas outlet, the resulting differential temperature will indicate the occurrence of afterburning in the upper disengaging zone and the presence of oxygen in the disengagement zone. Assuming the fast fluidized zones are operated in an oxygen deficient mode, the presence of oxygen at this point will in turn insure that complete regeneration is occurring in the dense bed zone.

A suitable arrangement for this control is shown in FIG. 2 wherein a first signal representing either the dense bed temperature as measured by temperature indicator 28 or the dense bed regenerator gas temperature as measured by temperature indicator 29 is compared in differential temperature controller 30 to a second signal representing the temperature of the flue gas as measured by temperature indicator 31 in order to generate a differential temperature value. The differential temperature controller then generates, based on the differential temperature value, a third signal which is sent to control valve 35 to regulate addition of regeneration gas to the dense bed zone. Due to the high concentration of carbon monoxide in the disengaging space, the low heat capacity of the regeneration gas and the usually small proportion of regeneration gas added to the dense bed regeneration zone, this differential control means is highly responsive. Accordingly, the regeneration gas addition to the second zone may be adjusted to maintain a predetermined temperature differential thereby insuring the presence of excess oxygen in the second combustion zone and complete regeneration, but at the same time limiting the gas flow to avoid any excessive temperature differential or regeneration gas addition.

It is foreseeable that relatively cooler regeneration gas will enter the disengagement zone from the riser. Therefore, it is possible to base control on a negative temperature differential between the second and first signal of as much as 20 Celsius degrees. However, a minimum positive differential of 11 Celsius degrees is usually required to insure the presence of oxygen, with 17 Celsius degrees being preferred. Of course, the maximum temperature differential will be dictated by the temperature limitations of the catalyst and equipment. Thus for most FCC or reduced crude conversion operations the maximum temperature is about 787 degrees Celsius (1450 degrees Fahrenheit) which will limit the differential temperature accordingly. However, the maximum positive temperature differential will usually not exceed 42 Celsius degrees where the regenerator is operated to minimize air requirements.

The following examples are presented to demonstrate the reduced heat release obtained by the process of this invention as well as a corresponding benefit to the reaction section. Nevertheless these examples represent only one possible method of practicing this invention and are not meant to restrict the broad scope of the claims appended hereto. Furthermore, these examples incorporate engineering calculations and estimates, based on operating data which reliably reflect actual operation.

EXAMPLE I

A high efficiency regenerator is operated without an additional dense bed regeneration zone to demonstrate the prior art process for regenerating coke containing catalyst from an FCC reactor hereinafter described in Example II. For purposes of illustration, reference will be made to the applicable elements of FIG. 2. Of course in this example there is no secondary addition of air to a dense bed regeneration zone.

The regenerator of this example, apart from the influence of catalyst loadings, operates at a pressure of 227 k pa gauge. In this operation 1,354,634 kg per hour of coke contaminated (spent) catalyst containing 0.85 wt. of coke and having a temperature of 525 degrees Celsius (977 degrees Fahrenheit) is transferred from an FCC reaction zone hereinafter described in Example II to mixing riser 22 through standpipe 21 where it is combined with 162,374 kg per hour of 163 degrees Celsius (325 degrees Fahrenheit) air and 1,354,634 kg per hour of regenerated catalyst having a temperature of 739 degrees Celsius (1362 degrees Fahrenheit) and a coke content of less than 0.05 wt. %, taken from upper collection zone 32 through standpipe 21'. Thus a total of 11,514 kg/hr. of coke is charged to the regenerator. The density of the catalyst and gas-catalyst mixture varies from 48–320 kg/m$^3$ in the lower combustion zone to 16–80 kg/m$^3$ in the combustion riser zone.

After passage through the combustion riser the mixture of catalyst and gas is initially separated at riser outlet 27. Spent regeneration gas and entrained catalyst are further separated in cyclones 34. Spent regeneration gas at a temperature of about 743 degrees Celsius (1370 degrees Fahrenheit), essentially free of carbon monoxide, and containing 2 mole percent oxygen leaves the regenerator through outlet 36. Regenerated catalyst particles from the riser outlet and cyclones collect in zone 32. Zone 32 contains a semifluidized bed of catalyst having a coke content of less than 0.05 percent and a temperature of 739 degrees Celsius (1362 degrees Fahrenheit).

EXAMPLE II

An FCC reaction zone continually receives the regenerated catalyst from the regeneration zone of Example I while sending coke contaminated catalyst to the regenerator in the amount previously stated. The reaction zone, except for the influence of catalyst loadings is operated at a pressure of 206 k pag. A total of 6,470 cubic meters per day of a vacuum gas oil feed is charged to the FCC riser at a temperature of about 262 degrees Celsius (504 degrees Fahrenheit). Properties of the charge stock are given in Table 1.

TABLE 1

| FEEDSTOCK PROPERTIES | |
|---|---|
| API | 21.20 |
| PCT Sulfur | 1.96 wt. % |
| Vanadium, PPM | .50 |
| Nickel, PPM | .28 |
| Conradson Carbon Content | .36 wt. % |
| IBP | 343° C. |
| 10% | 382° C. |
| 50% | 441° C. |
| 90% | 498° C. |
| E.B. | 552° C. |

The feedstock is contacted with 1,354,634 kg per hour of regenerated catalyst at a temperature of 739 degrees Celsius (1362 degrees Fahrenheit) in the lower portion of the reaction zone riser. After contact in the riser for approximately 2–5 seconds, a catalyst and hydrocarbon vapor mixture having an average temperature of 525 degrees Celsius (977 degrees Fahrenheit), is separated in a disengagement zone of the reactor. Adsorbed hydrocarbon vapors are stripped from downwardly descending catalyst by countercurrent contact with steam. The stripped catalyst particles having an average temperature of 525 degrees Celsius (977 degrees Fahrenheit) enter the regeneration zone of Example I with the properties described therein. The composition of the total reactor product is summarized in Table 2.

TABLE 2

| REACTOR PRODUCT COMPOSITION | Wt. % |
|---|---|
| $H_2S$ | .76 |
| $C_2$ Minus | 4.36 |
| $C_3$ | 5.95 |
| $C_4$ | 9.44 |
| Gasoline | 42.84 |
| IBP | 46.0° C. |
| EP | 221.0° C. |
| Light Cycle Oil | 17.2 |
| IBP | 215.0° C. |
| EP | 338.0° C. |
| Clarified Oil | 14.85 |
| Coke | 4.59 |
| Total | 99.99 |

EXAMPLE III

The operation of a regeneration zone modified by the method of this invention is described herein. This regeneration zone is operated to remove coke deposits from spent catalyst used in a reaction zone processing the same quantity of feed as that given in Example II. In this example 1,803,710 kg per hour of spent catalyst containing 0.77 wt. % coke enters a regeneration zone as shown in FIG. 2. Thus a total of 13,888 kg per hour of coke enter the regeneration zone. The temperature of the spent catalyst entering mixing riser 22 is again 525 degrees Celsius (977 degrees Fahrenheit). Apart from the influence of catalyst loadings the regeneration zone is operated at 227 k pag. Catalyst from dense bed regeneration zone 32 is transferred via standpipe 21' at a rate of 1,803,693 kg per hour to mixing riser 22 where it is mixed with the spent catalyst and 118,866 kg per hour air having a temperature of 163 degrees Celsius (325 degrees Fahrenheit). The density of the catalyst and gas catalyst mixture again varies from 48–320 kg/m$^3$ in the lower combustion zone and from 16–80 kg/m$^3$ in the combustion riser zone.

Catalyst and regeneration gases are initially separated upon discharge from the combustion riser 33. Separation causes catalyst particles to move downward and collect in dense bed regeneration zone 32 along with catalyst from cyclones 34. The dense bed regeneration zone is operated as a dense fluidized bed having an average density of 320–801 kg/m$^3$. Air having an initial temperature of 163 degrees Celsius (325 degrees Fahrenheit) is injected into bed 32 at a rate of 40,846 kg/hr. After combination regeneration gas from the riser and dense bed regeneration zone is separated from entrained catalyst in cyclones 34. The combined regeneration stream now relatively free of catalyst has a temperature of 704 degrees Celsius (1300 degrees Fahrenheit) along with a $CO_2/CO$ ratio of 3 and an oxygen content of 0.10 mole percent. Fully regenerated catalyst in bed 32 contains less than 0.05 wt. % carbon but has only been heated to 699 degrees Celsius (1290 degrees Fahrenheit) by the regeneration process.

EXAMPLE IV

The benefits to the reaction zone from the reduced regenerated catalyst temperature are demonstrated in the product yield from the reactor receiving and supplying the catalyst in Example III.

Regenerated catalyst from the regeneration zone of Example III is continually supplied to an FCC reaction zone similar to that described in Example II. The reaction zone is operated at a dilute phase pressure of 206 k pag. Feed totaling 6,470 cubic meters per day of vacuum gas oil enters the lower portion of the riser at a temperature of 262 degrees Celsius (504 degrees Fahrenheit). The properties of the feed are the same as those given in Table 1 of Example II. Regenerated catalyst at a temperature of 699 degrees Celsius (1290 degrees Fahrenheit) contacts the combined feed in the lower portion of the riser at a rate of 1,803,693 kg per hour thereby providing a catalyst to oil ratio of 7.23. After contact in the riser for approximately 2–5 seconds, oil vapor and catalyst are separated in the disengagement zone of the riser. Temperatures of the catalyst and vapor leaving the disengagement zone average 525 degrees Celsius (977 degrees Fahrenheit). Following stripping of hydrocarbon vapors, spent catalyst having 0.77 wt. % coke is returned to regeneration zone III at a temperature of 525 degrees Celsius. A hydrocarbon product stream having the properties listed in Table 3 is recovered from the reaction zone.

TABLE 3

| REACTOR PRODUCT COMPOSITION | Wt. % |
|---|---|
| $H_2S$ | .83 |
| $C_2$ Minus | 3.44 |
| $C_3$ | 6.47 |
| $C_4$ | 10.33 |
| Gasoline | 46.3 |
| IPB | 46° C. |
| EP | 221° C. |
| Light Cycle Oil | 15.20 |
| IBP | 215° C. |
| EP | 338° C. |
| Clarified Oil | 11.87 |
| Coke | 5.56 |
| Total | 100.0 |

A comparison of the foregoing examples illustrates the increased coke burning capacity of a regeneration zone operated in accordance with this invention.

In Example I a total of 11,514 kg per hour of coke is removed from the catalyst. In Example III 13,883 kg per hour of coke is removed to completely regenerate the catalyst and the average temperature of the regenerated catalyst is lowered by 40 Celsius degrees.

As demonstrated by the product compositions from the reaction zones, the lowering of the catalyst temperature and concomitant increase in catalyst to oil ratio improves the yield of valuable products. With the modified regeneration zone the same reactor operations convert the same amount of feed into an additional 3.5 wt. % of gasoline in spite of the higher coke yield for the lower temperature operation. This increase in gasoline yield results in only a 2 wt. % loss in light cycle oil. The examples also show an overall reduction in the air requirements for the regeneration zone of this invention. In the conventional regeneration zone of Example I, 14.2 kg of air were required for each pound of coke removed whereas in Example III the regeneration zone of the invention required only 11.5 kg of air per pound of coke. Thus the same amount of feed can be processed more advantageously as a result of this regeneration process.

The increased coke burning capacities of this invention are established by the preceding examples. It is also readily appreciated from the examples that the herein described regeneration method will permit larger quantities of feed, or feeds having increased coke producing tendencies, to be processed at optimum reaction conditions.

It is believed that the benefits achieved by increasing the amount of highly regenerated catalyst which can be delivered to the reaction will also transfer to other hydrocarbon conversion processes which may employ a fluidized reactor.

We claim as our invention:

1. A process for the regeneration of spent hydrocarbon conversion catalyst withdrawn from a fluidized reaction zone, which process comprises the steps of:

(a) passing to a lower locus of a combustion zone of a riser-type fluidized regeneration zone: (i) spent catalyst from said reaction zone, (ii) a stream comprising regenerated catalyst from a hereinafter described dense bed regeneration zone, and (iii) a first oxygen containing regeneration gas stream in an amount sufficient to maintain fast fluidized conditions, which include a catalyst density of 3 to 25 lbs. per cubic foot and a superficial gas velocity of 3 to 10 feet per second, within said combustion zone and to oxidize coke along with coke combustion by-products;

(b) oxidizing coke and coke combustion by-products in said combustion zone while transporting said spent and regenerated catalyst upward in cocurrent flow with rising regeneration gas;

(c) passing catalyst and regeneration gas upward in cocurrent flow from the combustion zone into a riser regeneration zone located above said combustion zone and having a catalyst density of from 1 to 8 pounds per cubic foot and lower than said combustion zone and a gas velocity greater than 10 feet per second, and therein oxidizing coke and coke combustion by-products to produce partially regenerated catalyst and a spent first regeneration gas, having a mole ratio of $CO_2/CO$ of from about 0.7 to about 2.0;

(d) discharging partially regenerated and regenerated catalyst and said spent first regeneration gas from an upper locus of said riser regeneration zone into a catalyst disengagement zone through an outlet means that effects at least a partial separation of catalyst and regeneration gas and thereby causing an initial separation of catalyst and the spent first regeneration gas;

(e) allowing partially regenerated and regenerated catalyst discharged through said outlet means to settle downward through a dilute phase above a dense fluidized bed, having a density of 30 to 50 pounds per cubic foot, of a dense bed regeneration zone located below said dilute phase and said disengagement zone while flowing countercurrent to a rising second regeneration gas, and introducing into the dense fluidized bed a second oxygen containing regeneration gas stream in a quantity at least sufficient to produce regenerated catalyst having less than 0.1 wt. % coke and to oxidize essentially all of the carbon monoxide produced within said dense bed regeneration zone to carbon dioxide;

(f) combining said spent first regeneration gas with the second regeneration gas, which contains at least 0.5 mole % $O_2$ and emanates from said dense bed regeneration zone in said disengagement zone, and producing a combined spent regeneration gas having a $CO_2/CO$ mole ratio in the range of about 1 to 5;

(g) withdrawing said combined spent regeneration gas from the disengagement zone; and, (h) withdrawing regenerated catalyst from said dense bed having an average temperature in the range of 620 to 787 degrees Celsius and returning at least a first portion of said regenerated catalyst to said reaction zone and at least a second portion of regenerated catalyst to the lower locus of the combustion zone pursuant to step (a) above.

2. The process of claim 1 wherein the quantity of regeneration gas added to said dense bed regeneration zone is sufficient to provide oxygen required to oxidize carbon monoxide in said spent regeneration gas discharged from said riser regeneration zone in addition to producing regenerated catalyst within the dense bed regeneration zone.

3. The process of claim 1 wherein regenerated catalyst is returned from said dense bed regeneration zone to said combustion zone through an internal standpipe.

4. The process of claim 1 wherein spent catalyst, the regenerated catalyst stream, and regeneration gas are combined in a mixing zone prior to entering said combustion zone.

5. The process of claim 1 wherein between 65 and 90 wt. percent of the coke on the spent catalyst entering the combustion zone is removed during passage through the combustion and riser regenerator zones.

6. The process of claim 1 wherein the partially regenerated catalyst and spent first regeneration gas from the riser regeneration zone are transferred to the disengagement zone by a substantially horizontal conduit and the combustion zone and riser regeneration zone are in side-by-side relationship to the dense bed regeneration zone and disengagement zone.

7. A process for the regeneration of particulate hydrocarbon cracking catalyst withdrawn from a fluidized catalytic cracking reaction zone, which process comprises the steps of:

(a) passing spent catalyst from said reaction zone into a lower locus of a combustor zone of a riser-type fluidized catalytic cracking regeneration zone together with a stream consisting of regenerated catalyst from a hereinafter described dense bed regeneration zone and an oxygen-containing regeneration gas in sufficient quantity to obtain fast fluidized conditions through said combustor zone and to oxidize coke and coke combustion by-products, said fast fluidized conditions including a catalyst density of 3 to 25 pounds per cubic foot and a superficial gas velocity of 3 to 10 feet per second;

(b) oxidizing coke and coke combustion by-products in said combustor zone while transporting catalyst upward with cocurrently flowing regeneration gas;

(c) passing said catalyst and regeneration gas mixture upward from the combustor zone into a riser regeneration zone located above said combustor zone and operated at a catalyst density of from 1 to 8 pounds per cubic foot lower than said combustor zone and with a gas velocity greater than 10 feet per second and therein oxidizing coke and coke combustion by-products to produce partially regenerated catalyst and a spent first regeneration gas having a mole ratio of $CO_2/CO$ of from about 0.07 to 2.0;

(d) discharging fully regenerated and partially regenerated catalyst and the spent first regeneration gas from an upper locus of said riser regeneration zone into a catalyst disengagement zone through an outlet means that effects at least a partial separation of catalyst and regeneration gas and thereby causing an initial separation of partially regenerated catalyst and said first regeneration gas;

(e) allowing at least 70 wt. % of the partially regenerated catalyst discharged into the catalyst disengagement zone through said outlet means to settle downward through a dilute phase located above a dense phase catalyst bed having a density of 30 to 50 pounds per cubic foot retained in a dense bed regeneration zone located below said dilute phase and said disengagement zone, and introducing into the dense bed regeneration zone a second oxygen-containing regeneration gas stream at a rate which is adjusted in response to a hereinafter defined output signal;

(f) combining said spent first regeneration gas with a second regeneration gas, in said disengagement zone to obtain a combined regeneration gas having a $CO_2/CO$ mole ratio of from 1 to about 5, said second regeneration gas comprising at least 0.5 mole % oxygen and emanating from said dense bed regeneration zone and rising upward countercurrent to descending catalyst, and removing the combined regeneration gas from said disengagement zone;

(g) measuring the temperature of the combined regeneration gas, comparing said temperature to a set point, and generating from this comparison said output signal, which determines the flow rate of the second oxygen-containing regeneration gas stream to the dense bed regeneration zone such that said set point is not exceeded; and (h) withdrawing regenerated catalyst from said dense bed regeneration zone having an average temperature in the range of 620 to 787 degrees Celsius and returning said regenerated catalyst particles to said reaction zone.

8. The process of claim 7 wherein said set point is equal to a maximum operating temperature for the regeneration equipment.

9. The process of claim 8 wherein the set point is equal to 815 degrees Celsius.

10. The process of claim 7 wherein said set point is a temperature measured within the disengagement zone, and the comparison provides a measure of the degree of afterburning occurring within the disengagement zone.

11. The process of claim 7 wherein at least 80 wt. percent of the catalyst discharged from the upper locus of said riser regeneration zone falls downward countercurrent to rising gas having an oxygen content above 0.5 mole percent.

* * * * *